United States Patent [19]

Jansz

[11] 4,288,178

[45] Sep. 8, 1981

[54] APPARATUS FOR GENERATING A RETROPULSIVE FORCE ON A BODY SUCH AS A PILE

[75] Inventor: Joost W. Jansz, The Hague, Netherlands

[73] Assignee: Hollandsche Beton Groep N.V., The Hague, Netherlands

[21] Appl. No.: 30,808

[22] Filed: Apr. 17, 1979

[30] Foreign Application Priority Data

Apr. 18, 1978 [NL] Netherlands ..... 04128

[51] Int. Cl.[3] ..... E02D 7/00

[52] U.S. Cl. ..... 405/228; 405/232

[58] Field of Search ..... 405/195, 224, 227, 228, 405/232; 114/264, 265, 294, 295

[56] References Cited

U.S. PATENT DOCUMENTS

| | | | |
|---|---|---|---|
| 2,986,889 | 6/1961 | Ludwig | 405/224 |
| 3,760,875 | 9/1973 | Busking | 114/264 X |
| 4,063,599 | 12/1977 | Jansz | 405/228 X |

FOREIGN PATENT DOCUMENTS

| | | | |
|---|---|---|---|
| Ad.88968 | 3/1967 | France | 405/224 |
| 7410905 | 2/1976 | Netherlands . | |
| 7512021 | 4/1977 | Netherlands . | |
| 7514331 | 6/1977 | Netherlands . | |

*Primary Examiner*—David H. Corbin

*Attorney, Agent, or Firm*—Sughrue, Mion, Zinn, Macpeak & Seas

[57] ABSTRACT

A method and apparatus for generating a retropulsive force on a body upon which forces act which try to displace said body. More in particular the invention deals with holding upright an enlongated body such as a pile when in unstable equilibrium or by returning a floating body to its position of origin. The unstable pile is held upright by a weight guided in the pile and supported from a cable guided on the pile at a distance above the weight. The floating body is held in position by a weight guided on a stable pile and supported by cables which are connected with the body and run through guides at the upper end of the pile.

6 Claims, 3 Drawing Figures

3
7
2
6
1
5
5
4

10
13
14
11
12

APPARATUS FOR GENERATING A RETROPULSIVE FORCE ON A BODY SUCH AS A PILE

BACKGROUND OF THE INVENTION

The invention relates to a method for generating a retropulsive force on a body which under the influence of external forces and/or its own weight endeavours to take a position deviating from the desired position, said retropulsive force being derived from a force in vertical direction and exerting an increasing retropulsive transverse component on the body upon increasing deviations from the desired position.

Every object floating in water and connected to an anchor will be brought back upon displacement from the anchor by the weight of the anchor chain.

A buoy connected by a taut connection to an anchor straight therebelow will experience a retropulsive force due to the fact that the upward buoyant force acting on the buoy body then acquires a transverse component. Accordingly it is known to derive the retropulsive force from a force in vertical direction, for instance the weight of the anchor chain or from the upward force provided by the buoyancy.

When placing elongated bodies, such as piles, particularly a ramming pile, in an upright position the problem arises that the pile maintains a straight downward position as long as it has been attached to the hoisting means but acquires an unstable equilibrium as soon as the lower part touches the ground or bottom.

Above the water level and even therebelow at not too great a depth this problem may be solved by utilising guiding means or by supporting constructions at the lower part.

When ramming below the water surface at greater depths such expedients cannot be availed to any longer.

Consequently it has already been proposed, for example in Dutch Patent Applications Nos. 74.10905, 75.12023 and 75.14331 to utilise a yoke for slidably guiding the pile together with the ram in such a manner that during the ramming the cable supporting the yoke may be kept taut so that a tumbling down at the start of the ramming operation may be prevented. However the latter method incurs yet many difficulties.

SUMMARY OF THE INVENTION

The object of the invention is to provide first of all a method and a device for stabilising an upright elongated body being in unstable equilibrium while utilising a principle that also advantageously may be used for other bodies subject to unwanted displacements, such as mooring devices, buoyant dispositions and the like, which principle may not only be used on the aforesaid fields but may be utilised in every instance in which an unstable situation occurs when a suspended object merges into an upright resting object lacking however a fixed position. In this respect reference may be made for instance the the erection of high antenna poles.

In accordance with the invention this object is now reached by acquiring this transverse component by means of an object exerting a force substantially directed downwardly on a tensioning means guided on an upward elongated body standing on or in the ground or bottom, said tensioning means further being guided through an eye present on the said body at a distance above the said object.

Hence for generating a retropulsive force use is made of a force that however contrary to the weight of an anchor chain operates along a fixed path and that upon deviations from the path acquires a transverse component endeavouring to correct the deviation.

Preferably this force is generated by a weight suspended from the tensioning means, which tensioning means between the weight and the suspension point is guided on the body on which the weight is also being guided.

Consequently as soon as a deviation occurs in the path of the tensioning means conductive to a bend in the vertical path of the tensioning means, the tensioning means being under the influence of the gravitational force of the weight will generate a transverse component at the location of the bend and at the location of the fastening point of the tensioning means.

Thus in accordance with the invention the body may consist of a pole or pile being in unstable equilibrium when resting on its point, the elongated body may form part of or may be attached to the pole or pile, respectively, the eye may be present at or approximately at the top of the pole or pile and the tensioning means loaded by the weight may consist of at least one cable running through a guiding eye on the top of the pile or pole and/or the ram.

A pile including optionally a ram or a vibration device positioned thereon will be in unstable equilibrium when the pile is resting on its point. When placing a weight close to the lower end of the pile such that the weight is slidable on the pile and suspending the weight from tensioning means passing through guiding eyes close to the upper end of the pile and/or the device present thereon the effect will be reached that as soon as the pile will deviate from the vertical position the tensioning means starts to run in a bend so that at the location of the bend and hence at a distance as far as possible from the point a retropulsive force is generated, said force increasing with increasing deviation of the pile from the vertical position. Thereby it becomes possible not only when ramming at the surface but also below the water level and particularly when ramming at great depths to place and to maintain the pile in vertical position without requiring other expedients to keep the pile upright while there are no taut tensioning means hampering the ramming.

In this way there is provided an extraordinary simplification of the ramming at great depths, where no longer auxiliary constructions can be used.

In accordance with an other possible application of the inventive principle the body might consist of a buoyant body and the upright elongated body being a pile rammed into the bottom having at its upper end guiding eyes for the one or more tensioning means. In this way it is possible to bring floating bodies such as artificial isles under the influence of a retropulsive force derived from the weight.

BRIEF DESCRIPTION OF THE DRAWING

The invention will now be described in detail referring to the drawings.

DESCRIPTION OF PREFERRED EMBODIMENTS

Figure 1:
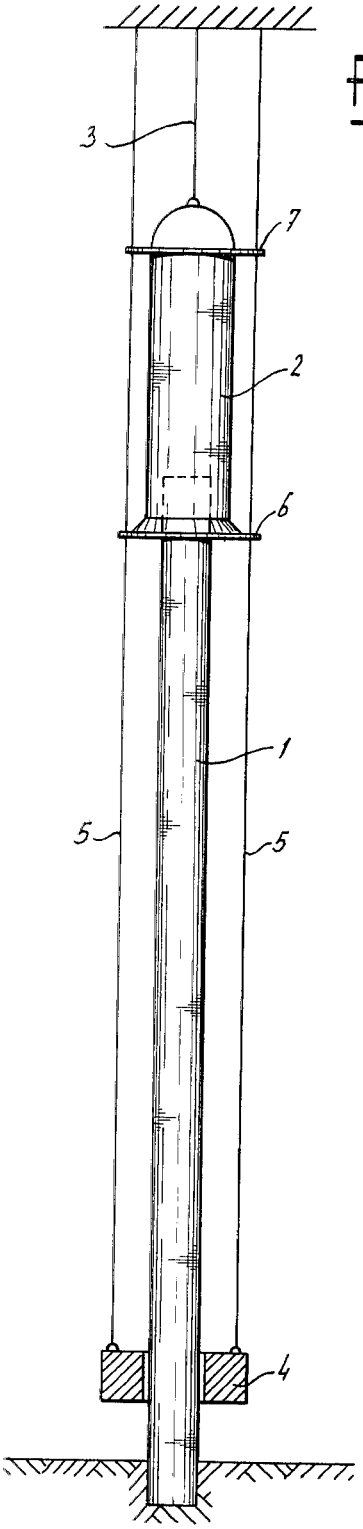
FIGS. 1, 2 and 3 show schematical representations of three possible applications.

Referring to FIG. 1 there is shown a pile 1 the upper end of which extends into a ram 2 suspended from a hoisting cable 3.

Close to the lower end of the pile 1 resting on the bottom there is an annular weight 4 suspended from cables 5 running through guiding eyes 6 close to the upper end of the pile and 7 close to the upper end of the ram. These cables 5 run to a fixed point, not shown, such as a hoisting device.

It will be clear that when the pile and the ram as a whole will leave the vertical position the cables 5 also leave this position with the result that the tension present in the cables at the bends will generate a transverse component that will erect the whole again. It is evident that the weight 4 will have to be of such dimension that thereby a transverse component is generated capable of providing a counter moment greater than the moment caused under the influence of its own weight of the pile or the ram, respectively, at the prevailing deviation.

During the lowering the weight 4 may be present close to the upper end of the pile.

The possibility shown furthermore has the advantage that the ram may always be separated from the pile even if the pile has not yet been rammed in and that during the ramming one may keep the hoisting cable 3 hanging in a completely slack condition.

When ramming from a vessel and hence the cables 5 being attached to this vessel the swell of the waves does not have any influence on the ramming operations because the swell only causes a corresponding movement of the weight 4 upwards and downwards which however does not prevent the functioning thereof.

The weight 4 may even rest on the bottom as long as the cables 5 do not take a slack condition.

In view of the fact that the method and the device according to the invention may provide stability to an unstable system it is also possible to place a pile at an angle with respect to the vertical by exerting a transverse force equalling the retropulsive force.

Figure 2:
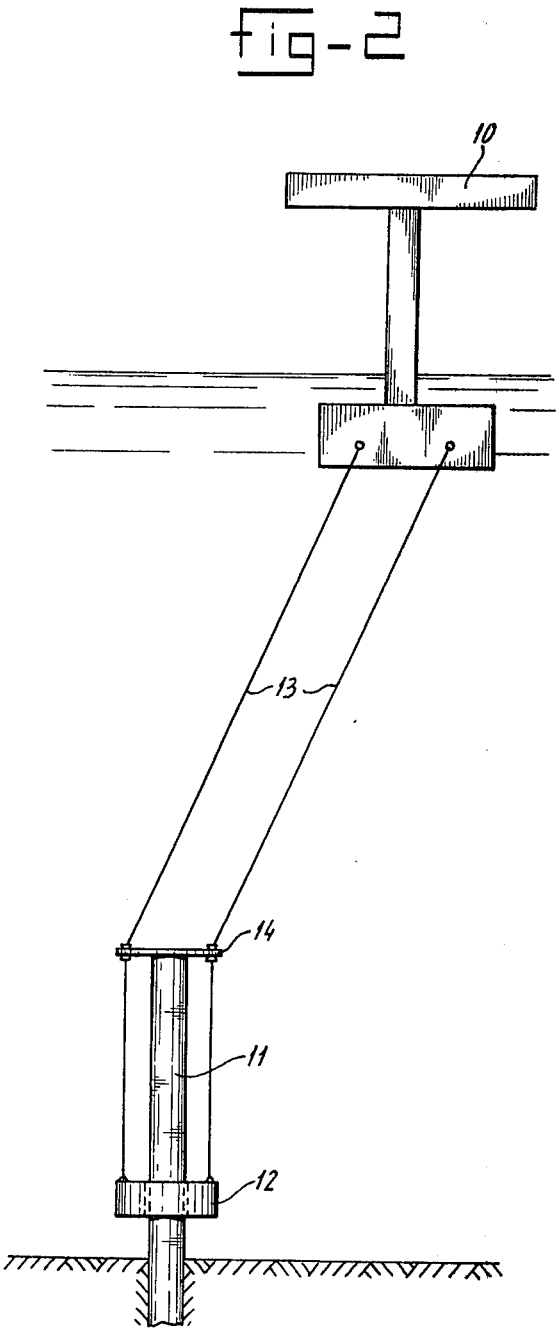

Referring to FIG. 2 there has been shown an embodiment consisting of a schematically indicated floating construction 10, a pile 11 rammed into the bottom on which a weight 12 has been guided, said weight being connected to the construction 10 by means of cables 13 running through the guiding eyes 14. FIG. 2 shows the position deviating from the desired position vertically above the pile 11. Under influence of the weight the cables 13 endeavour to return the construction.

It will be clear that the weight does not have to be provided on the pile. Guides in the pile or on the guiding means are conceivable likewise. Moreover other possible applications than those described here are also conceivable.

Figure 3:
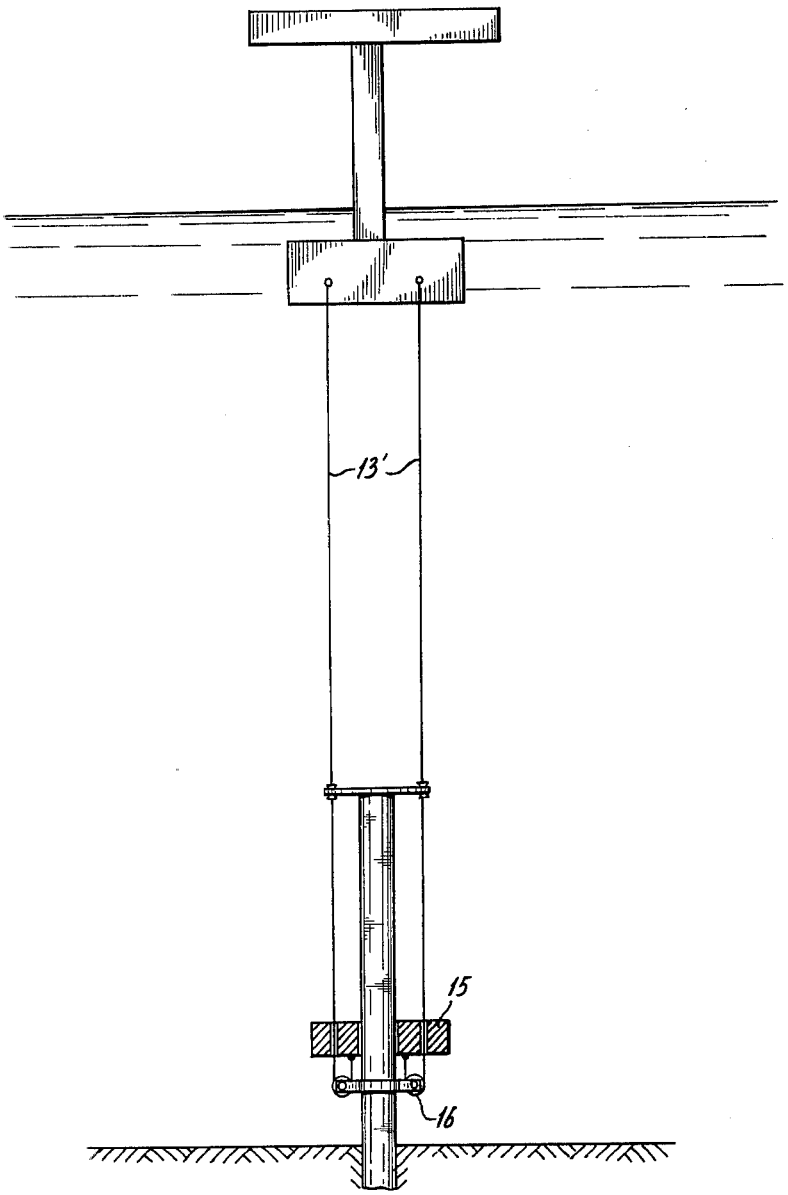

Referring to FIG. 3 there is shown a variant of FIG. 2. Instead of the weight 12 there is now utilised a body 15 having buoyancy whereas the cables 13' are guided on reversing disks 16 attached to the pile. The operational effect further remains the same.

I claim:

1. An apparatus for generating a retropulsive force on at least one object which tends to deviate from a desired vertical disposition under the influence of detrimental forces, said apparatus comprising:

an elongated member standing upright at a ground surface and having a desired vertical disposition;

force means guided by said elongated member;

tensioning means for supporting said force means under tension above said ground surface, said tensioning means being guided through said elongated member above said force means and supported above said elongated member by support means, said tensioning means applying no retropulsive force to said object when said object is in said desired vertical disposition, and applying an increasing retropulsive force to said object when said object increasingly deviates from said desired vertical disposition, said tensioning means applying an amount of retropulsive force proportional to the amount of deviation.

2. The apparatus of claim 1 wherein said elongated member is unstable when resting on said ground surface, said tensioning means are guided through an upper portion of said elongated member and said support means are attached to a fixed point, whereby said retropulsive force is applied to said elongated member.

3. The apparatus of claim 2 wherein said elongated member is a ramming pile having at least one guiding eye at the top thereof, and said tensioning means comprises a cable running through said at least one guiding eye.

4. The apparatus of claim 1 wherein said support means is movable under the influence of said detrimental forces and said elongated member is fixed to said ground surface, whereby said retropulsive force is applied to said support means.

5. The apparatus of any one of claims 1 through 4 wherein said force means comprise a weight.

6. The apparatus of any one of claims 1 through 4 wherein said force means comprise a body lighter than water, said tensioning means connected to the body via direction-reversing pulleys.

* * * * *